US005282501A

United States Patent [19]

Miller, III

[11] Patent Number: 5,282,501

[45] Date of Patent: Feb. 1, 1994

[54] WOOD PROCESSING APPARATUS

[76] Inventor: George E. Miller, III, 330 Stilson Canyon Rd., Chico, Calif. 95928

[21] Appl. No.: 11,341

[22] Filed: Jan. 29, 1993

[51] Int. Cl.[5] ..... B27L 7/00; B27C 9/00

[52] U.S. Cl. ..... 144/3 K; 83/105; 144/193 R; 144/193 A; 144/366; 144/242 R; 198/632; 414/505; 414/523

[58] Field of Search ..... 424/503, 523; 198/313, 198/318, 632; 83/104, 105, 109, 155, 928; 144/3 K, 193 R, 193 A, 242.12, 242 E, 366

[56] References Cited

U.S. PATENT DOCUMENTS

| | | | |
|---|---|---|---|
| 2,657,786 | 11/1953 | Loberg . | |
| 4,076,061 | 2/1978 | Greeninger . | |
| 4,176,696 | 12/1979 | Greeninger . | |
| 4,269,242 | 5/1981 | Smith et al. | 144/193 A X |
| 4,284,112 | 8/1981 | Hoskin | 144/3 K |
| 4,373,564 | 2/1983 | Heikkinen | 144/3 K |
| 4,478,263 | 10/1984 | Johnston . | |
| 4,609,018 | 9/1986 | Barker . | |
| 4,813,526 | 3/1989 | Belanger . | |
| 5,022,445 | 6/1991 | Holestine . | |
| 5,044,867 | 9/1991 | Pettijohn . | |

FOREIGN PATENT DOCUMENTS

| | | | |
|---|---|---|---|
| 74055 | 12/1917 | Austria | 198/113 |

OTHER PUBLICATIONS

"New Firewood Processors", Dec. 1989; Eaglewood Industries Ltd.

"Beaver Woodeater—Firewood Processing Systems"; 1986; Eaglewood Industries Ltd.

"Cub-Super Cub-Super Beaver III"; 1990; Eaglewood Industries Ltd.

"The Chomper—Fuelwood System"; Rainier Hydraulics, Inc.; undated.

*Primary Examiner*—W. Donald Bray

*Attorney, Agent, or Firm*—John P. O'Banion

[57] ABSTRACT

Disclosed is a transportable wood processing apparatus (10) for cutting, sorting and loading firewood and the like. A frame (12) is carried by wheels (14, 16) and includes a guide tongue (20) and trailer hitch (22) for moving the apparatus from location to location. A stop plate (42) sets the length of firewood which is cut by a reciprocating saw (38). A divider (54) is laterally offset from saw table (32) such that the cut firewood will fall either to side (58) or side (60) and be sorted according to relative size depending upon which side the center of gravity of the firewood lies. The cut firewood either falls into a feed conveyor (68) which then feeds a loading conveyor (70) for loading a vehicle or, if too large for direct loading, falls into a splitter conveyor (72) and is carried to a splitter table (74) for splitting with splitter (76). After being split, the firewood is placed into loading conveyor (70). Loading conveyor (70) is pivotally coupled to the frame (12) such that it can be rotated between an extended position for operation and folded back over frame (12) during movement from location to location.

12 Claims, 5 Drawing Sheets

WOOD PROCESSING APPARATUS

BACKGROUND OF THE INVENTION

1. Field of the Invention

This invention pertains generally to log cutting machines, and more particularly to a mobile apparatus for cutting and sorting firewood.

2. Description of the Background Art

It is common to cut firewood from pre-trimmed poles, trees and the like into lengths which are generally accepted for use in a household fireplace or wood stove. When the wood has a larger than acceptable diameter, it is also common to split the wood into smaller pieces. Saws, splitters and similar wood processing devices are well known. Once the wood is cut and split, it is generally hand sorted according to relative size and stacked in a central location.

Firewood processing devices heretofore developed have been designed primarily for cutting and handling generally straight lengths of wood which have been transported to a processing site. However, an increasing amount of firewood is available as agricultural "waste" which is generated by pruning and removing trees from almond, walnut, apple and other orchards. Such wood is typically bent, twisted and generally gnarly and, therefore, not suitable for processing with existing equipment which requires generally straight lengths of wood. Quite typically, a tree falls over in an orchard and is reduced to trimmed poles and a brush pile by the grower. The brush is removed immediately from the orchard and the poles are piled by the stump of the tree. After enough trees have fallen or have been pruned to generate a truck load of wood, or after a growing season passes, the wood is hauled off and processed. While some trees may yield as much as a cord of finished product, others yield as little as one cubic foot. Rarely does one tree produce a truck load of processed wood.

Furthermore, the waste product wood must be removed from the orchard with a minimum of disruption to normal farming activities. To do so, it is highly desirable to process the wood on site, thereby facilitating loading and removal. However, the wood is unlikely to be found in one central location, but will be scattered throughout the orchard. Therefore, there is a need for an apparatus which can be easily moved through an orchard from location to location and which will cut, sort and load firewood without disrupting the normal farming activities.

SUMMARY OF THE INVENTION

The present invention pertains to a transportable wood processing apparatus for cutting, sorting and loading cut wood which can be moved through an orchard from tree to tree. Instead of bringing the wood to the machine as is done with conventional units, the wood processing apparatus of the present invention is brought to the wood. No input system is required; instead, the wood is loaded onto the apparatus by hand.

The processed wood can be loaded by the apparatus into the same truck that pulls it from location to location through the orchard, or into a trailer which is coupled to the apparatus. As the apparatus is moved from location to location, the configuration of the apparatus is not changed in any way. Therefore, there is no loss in time resulting from set-up or take-down of the apparatus at each location in the orchard. Wood continues to be processed until finished.

By way of example and not of limitation, the wood processing apparatus of the present invention includes a frame which is carried by wheels, and which has a trailer hitch at each end of the frame for coupling to a trailer or a tractor, truck or other transport vehicle. An internal combustion engine powers a hydraulic pump which is in turn coupled to the various operational elements of the apparatus.

Wood which is to be processed by the apparatus is placed on a saw table located at the rear of the apparatus. A hydraulic powered circular saw positioned adjacent to the saw table cross-cuts the wood into lengths which are preset by an adjustable stop. Once the wood is cut, it falls from the saw table onto the lengthwise edge of an adjustable wedge-shaped divider. The lengthwise edge of the divider is laterally offset from that of the saw table such that the cut wood will fall to one side or the other depending upon which side of the divider the center of gravity of the cut wood lies. In this way, the cut wood is sorted according to relative size. Individual conveyors are positioned adjacent to each side of the divider to catch the cut wood as it falls to one side or the other. If the cut wood is too large, it falls into a splitter conveyor on the splitter side of the divider and is carried to a hydraulically powered splitter. Once split, the wood is placed into a loading conveyor which carries the wood to a truck or trailer. Otherwise, the cut wood falls into a feed conveyor on the loading side of the divider and is carried directly to the loading conveyor.

The loading conveyor is pivotally coupled to the frame and extends toward the front of the apparatus with a vertical inclination. In this way, the cut wood falls from the loading conveyor into a truck or trailer coupled to the front trailer hitch. When the processing is complete and the apparatus is to be transported to another job site by way of a highway or at high speeds, the loading conveyor is folded back over the apparatus and locked into a generally horizontal position.

An object of the invention is to provide a transportable apparatus for cutting, sorting and loading wood.

Another object of the invention is to provide for sorting cut wood according to relative size.

Another object of the invention is to provide for splitting cut wood which does not meet the sorting criteria for direct loading.

Another object of the invention is to provide a loading conveyor which can be pivotally folded back over the apparatus when not in use.

Another object of the invention is to provide for processing wood which is not straight.

Another object of the invention is to cut wood into preset lengths.

Another object of the invention is to provide for sorting wood according to relative diameter without the use of moving parts.

Further objects and advantages of the invention will be brought out in the following portions of the specification, wherein the detailed description is for the purpose of fully disclosing preferred embodiments of the invention without placing limitations thereon.

BRIEF DESCRIPTION OF THE DRAWINGS

The invention will be more fully understood by reference to the following drawings which are for illustrative purposes only.

DESCRIPTION OF THE PREFERRED EMBODIMENTS

Referring more specifically to the drawings, for illustrative purposes the present invention is embodied in the apparatus which is generally shown in FIG. 1 through FIG. 5. It will be appreciated that the apparatus may vary as to configuration and as to details of the parts without departing from the basic concepts as disclosed herein.

Figure 1:
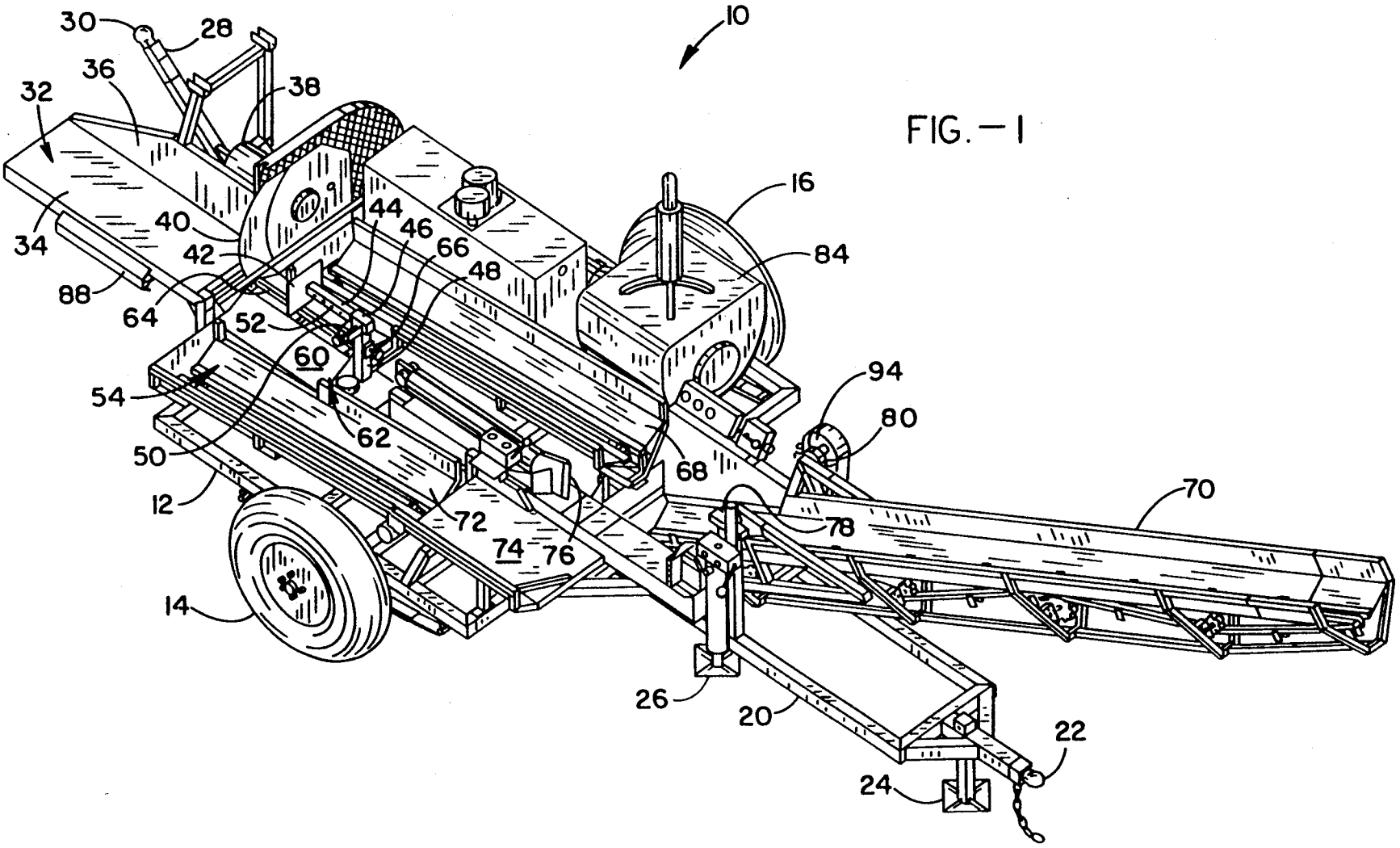
FIG. 1 is a perspective view of the apparatus of the present invention showing the loading conveyor in its extended position.
Figure 3:
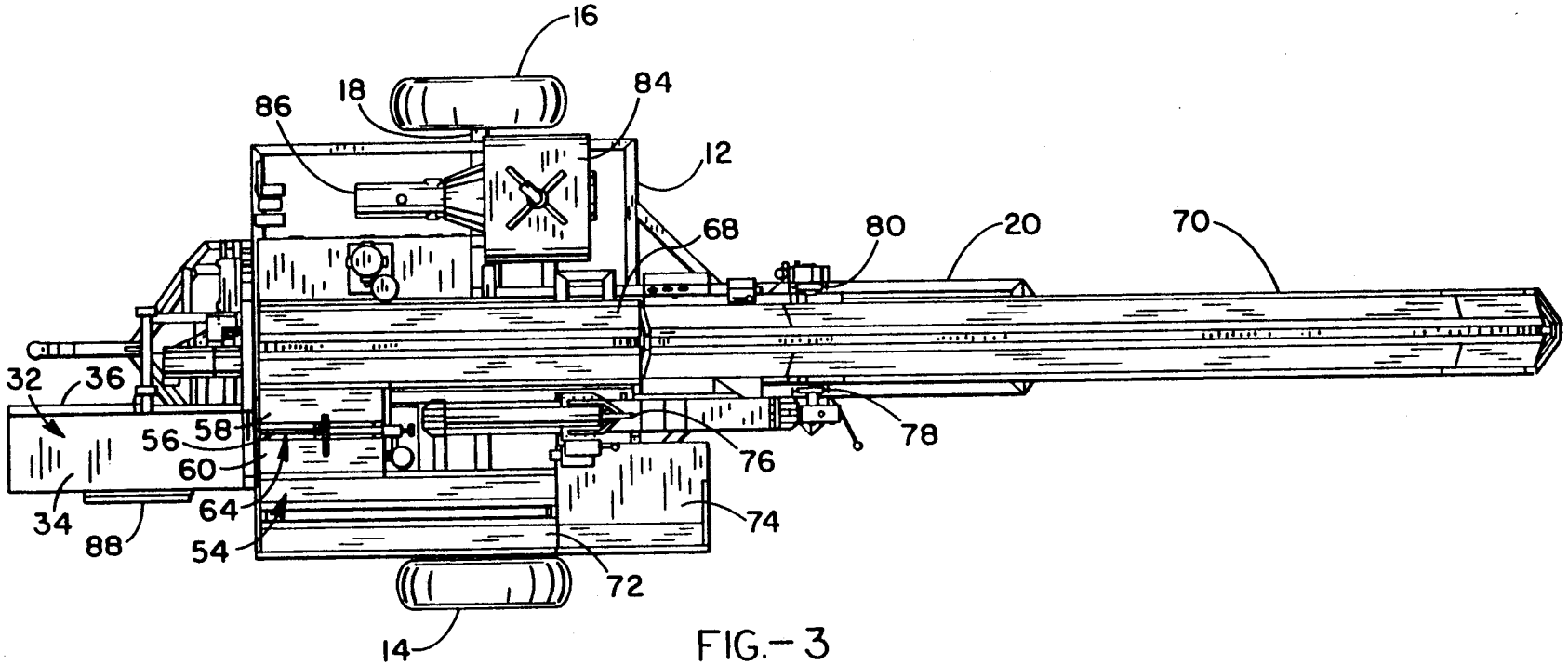
FIG. 3 is a plan view of the apparatus of the present invention showing the loading conveyor in its extended position.

Referring to FIG. 1, the wood processing apparatus 10 of the present invention includes a frame 12 which is generally supported by wheels 14, 16 which are rotatably coupled to frame 12 and preferably carried by an axle 18 (shown in FIG. 3). Frame 12 generally comprises a network of steel tubing configured and structured to support the various elements of the apparatus.

A guide tongue 20 extends from the front of frame 12 for positioning the apparatus 10 prior to operation. The apparatus can be pushed or pulled into position using guide tongue 20 for directional control. Guide tongue 20 includes a front trailer hitch 22 for coupling to a truck or other vehicle during transportation of the apparatus. A support leg 24 is provided to support guide tongue 20 and to level the apparatus during operation. To assist in uncoupling and coupling front trailer hitch 22 to a vehicle, a hydraulic powered lift foot 26 is also provided to raise and lower guide tongue 20.

Guide tongue 20 and front trailer hitch 22 are primarily for towing the apparatus from location to location. However, in the event that the apparatus becomes obstructed after operation and it is not possible to move forward, an auxiliary tow bar 28 having a rear trailer hitch 30 is provided at the opposite end of frame 12 so that the apparatus can be pulled away from the obstruction. When tow bar 28 is used, support leg 24 is maintained in its extended position and dragged along the surface for support.

A saw table 32 is mounted to frame 12 at the end opposite guide tongue 20, and includes a horizontal lower support member 34 and a vertical upper guide member 36 for supporting and guiding a log or other article of wood to be cut. In operation, an article of wood to be cut placed lengthwise along lower support member 34 with its side abutted against upper guide member 36. A saw 38 having a circular blade 40 is mounted on frame 12 such that blade 40 is positioned at the end saw table 32 and oriented substantially perpendicular to the longitudinal axis between the ends of saw table 32 for cross-cutting an article of wood. Preferably, saw 38 is pivotally coupled to frame 12 on a vertically oriented pivot arm (not shown) such that blade 40 can be moved across the end of saw table 32 laterally to make a cross-cut. Pivotally coupling saw 38 in this manner provides both a reciprocating sliding motion as well as a slight arcuate "swing" to its movement. Alternatively, saw 38 could be slidably coupled to frame 12 for lateral motion without an arcuate swing. While an articulating chain saw or the like could also be employed, a circular saw is preferred for ease of use and making a cleaner cut. In addition, since firewood is commonly cut into various lengths, means is provided to set the length of cut. When a log or the like is placed on saw table 32 to be cut, the user positions the end of the log is abutted against a stop plate 42. Stop plate 42 is attached to an arm 44 which slidably engages a receptacle 46 which is supported by standoff 48 which is mounted to frame 12. The position of arm 44 is adjustable by means of a pin 50 engaging one of several holes 52. Typically arm 44 is configured for adjustment of cut lengths between approximately fourteen inches (35.56 cm) and twenty-four inches (60.96 cm) although other sizes can be easily accommodated.

Figure 2:
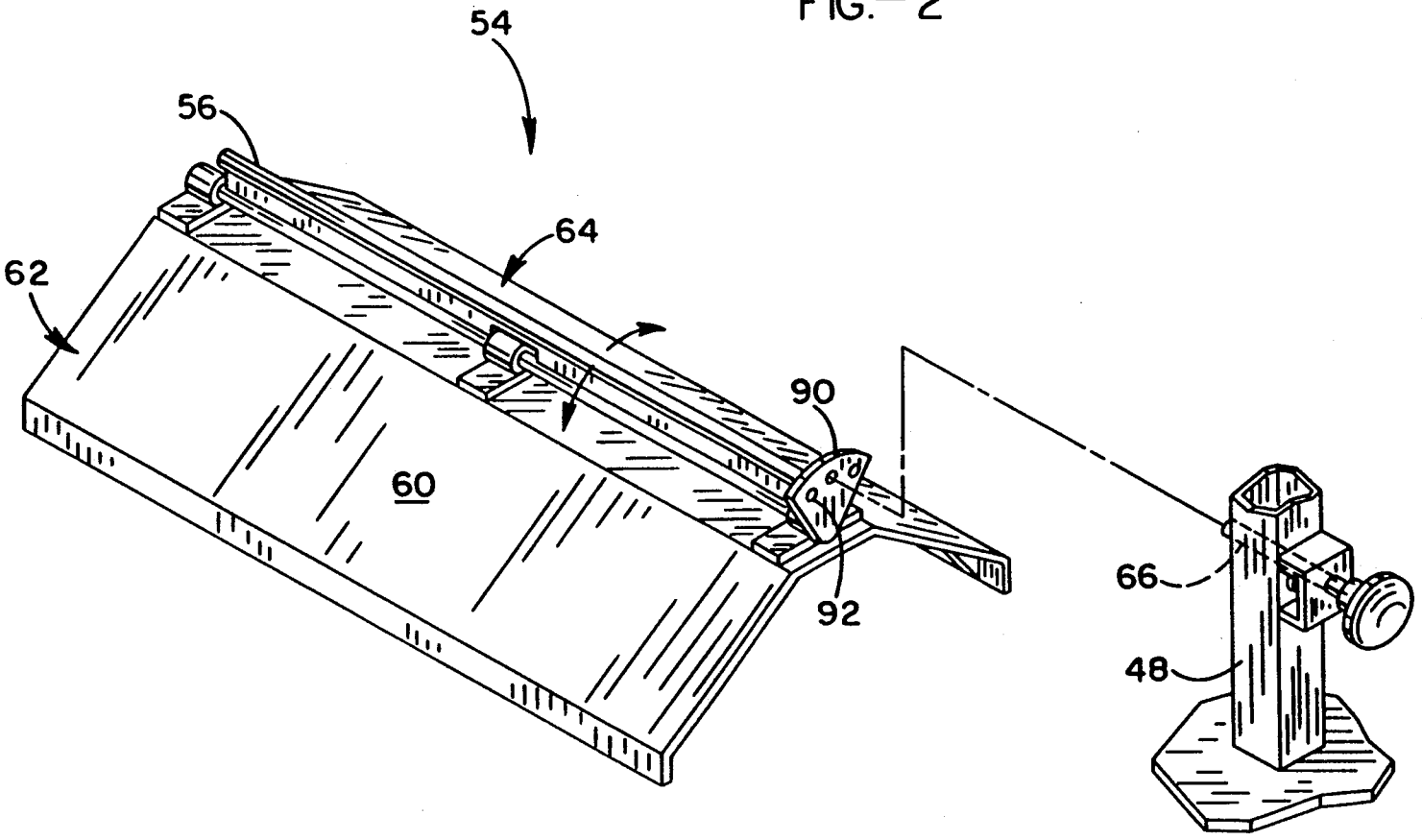
FIG. 2 is a perspective detail view of the sorter divider element of the present invention.

Referring also to FIG. 2 and FIG. 3, when the end of a log is abutted against stop plate 42 the portion to be cut off will project over the end of saw table 32 above a divider 54. Divider 54 is an elongated generally wedge-shaped structure having an upper lengthwise edge 56 and arcuate sides 58, 60. As can be seen in FIG. 2, upper lengthwise edge 56 is offset laterally from the longitudinal centerline extending between the ends of lower support member 34 in the direction of upper guide member 36. In addition, the vertical position of edge 56 is positioned approximately two inches (5.08 cm) below the vertical position of lower support member 34. Therefore, when the side of a log is abutted against upper guide member 36, the cut portion will fall with its center of gravity to one side or the other of divider 54. In this way, smaller diameter logs will have their center of gravity located on the side of divider 54 which faces toward upper guide member 36 and will fall in the direction of side 58 when cut. Larger diameter logs having their center of gravity located on the side of divider 54 facing away from upper guide member 36 will fall in the direction of side 60 when cut. As can be seen, the amount of lateral offset between saw table 32 and divider 54 will determine the size of logs which will fall to one side of divider 54 or the other. Therefore, divider 54 effectively sorts cut logs and other articles of wood in one of two categories according to relative size.

In the preferred embodiment, the lateral offset between divider 54 and saw table 32 is adjustable so that the relative sorting size can be varied. In this configuration, sides 58, 60 are defined by a lower wedge member 62, and edge 56 is defined by a divider bar 64. In the preferred embodiment shown in FIG. 2, divider bar 64 generally comprises an elongated rectangular bar sandwiched between upper and lower lengths of round stock. While it is preferred that divider bar 64 be generally rectangular in shape, other shapes can be employed without affecting functionality, so long as divider bar 64 forms a generally narrow and elongated edge 56.

Divider bar 64 and lower wedge member 62 are pivotally coupled along their corresponding lengthwise edges so that divider bar 64 can be pivoted toward either side of lower wedge member 62. A locking plate 90 having a plurality of holes 92 is attached to one end of divider bar 64 so that, once the position of divider bar 64 is selected, it can be secured in place at one end with a pin 66 or the like through one of the holes 92. Alternatively, divider bar 64 can be eliminated and divider 54 fashioned as a single wedge-shaped unit which is fixed in position or slidably coupled to frame 12.

A feed conveyor 68 is mounted to frame 12 and positioned such that one end is adjacent to the side of divider 54 facing toward upper guide member 36 in order to "catch" or receive an article of wood falling to that side. The other end of feed conveyor 68 is positioned away from divider 54 and toward the end of frame 12 to which guide tongue 20 is attached. Feed conveyor 68 "feeds" a loading conveyor 70, one end of which is positioned below the end of feed conveyor 68 while the other end extends away from frame 12 at a vertical inclination sufficient for carrying articles of wood to the bed of a truck or to produce a high stack of wood.

A splitter conveyor 72 is mounted to frame 12 and positioned such that one end is adjacent to the side of divider 54 facing away from upper guide member 36 so that it will receive an article of wood falling to that side of divider 54, while the other end of splitter conveyor 72 extends toward the end of frame 12 to which guide tongue 20 is attached and carries the larger articles of wood to a splitter table 74. A splitter 76 is mounted to frame 12 in a position adjacent to splitter table 74 so that the logs can be further processed. Preferably, splitter 76 is mounted to frame 12 using shock absorbing mounts, such as rubber blocks or the like, so that twisting motion resulting from splitting an article of wood is not translated to frame 12. Splitter 76 is also positioned adjacent to the end of loading conveyor 70 which is fed by feed conveyor 68 at a higher elevation so that the split articles of wood can be pushed or dropped into loading conveyor 70.

Figure 4:
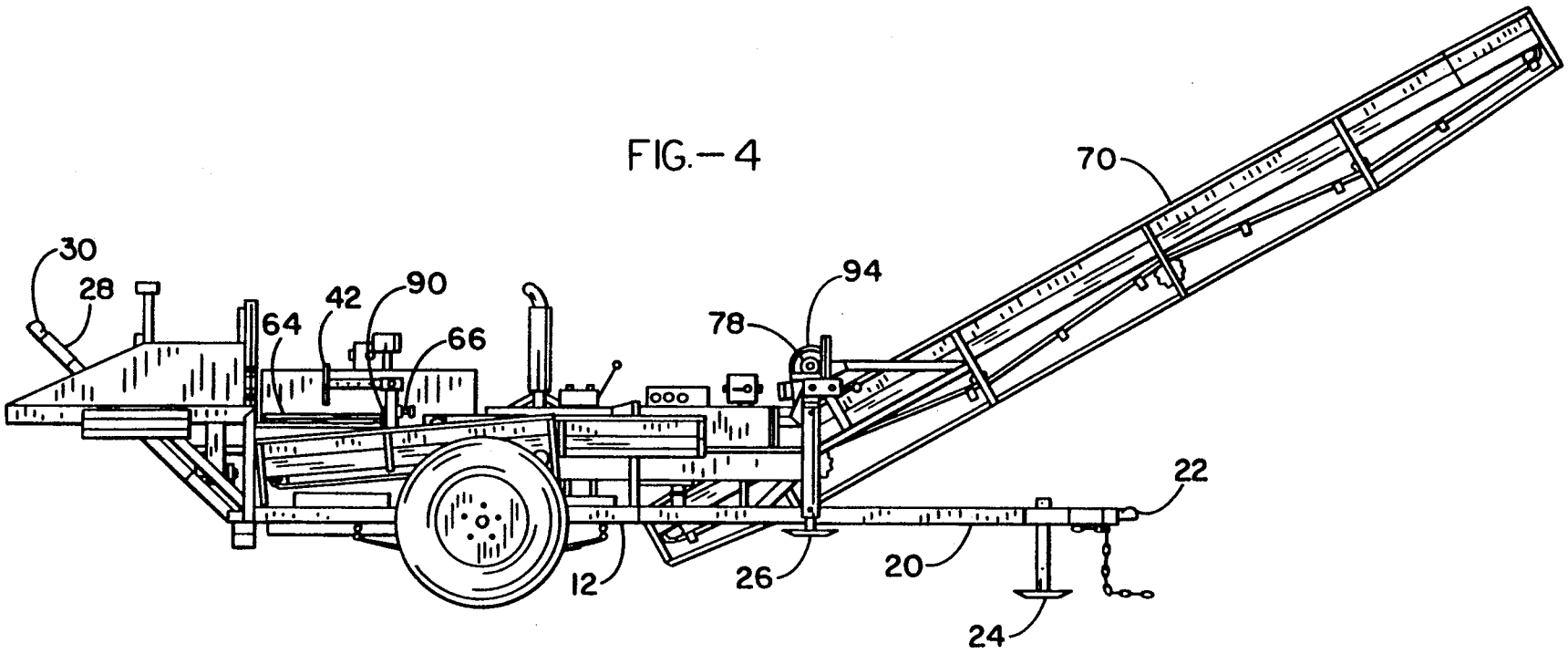
FIG. 4 is a side elevation view of the apparatus of the present invention showing the loading conveyor in its extended position.
Figure 5:
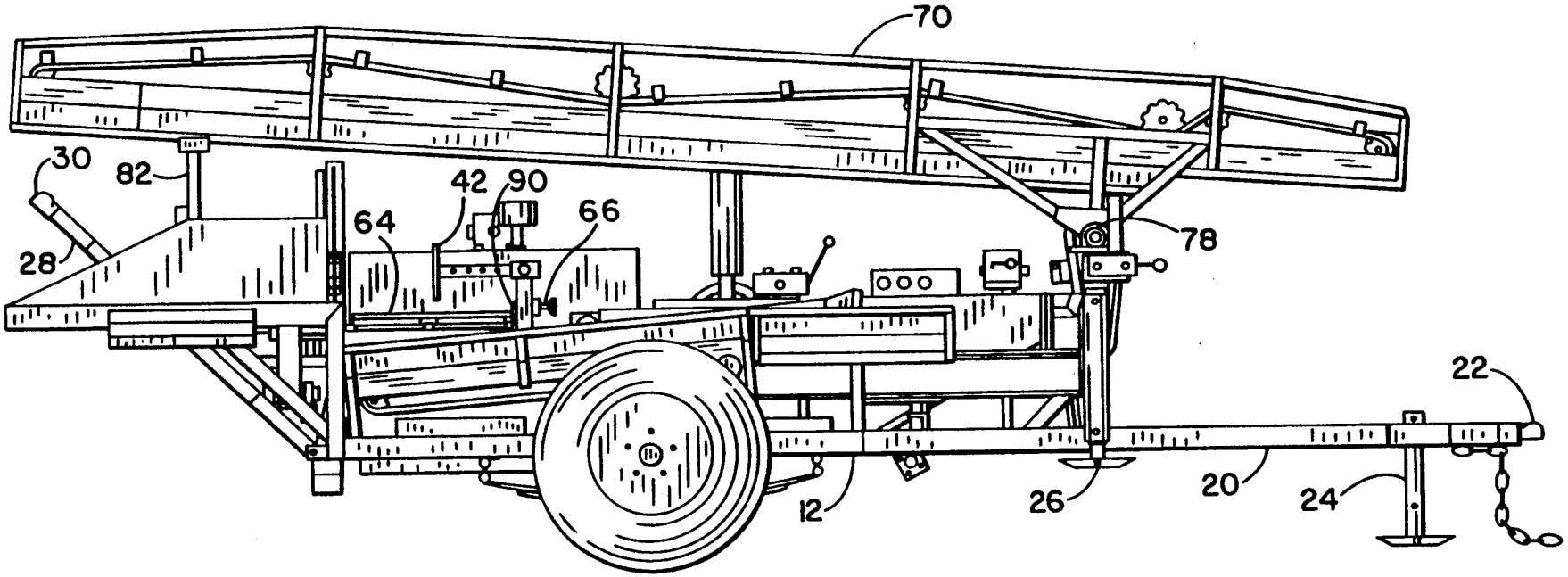
FIG. 5 is a side elevation view of the apparatus of the present invention showing the loading conveyor in its folded back position.

Referring also to FIG. 4 and FIG. 5, loading conveyor 70 is pivotally coupled to frame 12 with bearings 78, 80 such that it can be extended during operation and folded back over frame 12 during transportation. In its extended position (FIG. 4), loading conveyor 70 is positioned with an inclination sufficient for cut articles of wood to be loaded into a truck or other transport vehicle. In its folded back position (FIG. 5), loading conveyor 70 is folded back over frame 12 in a generally horizontal position and supported by an arm 82. Note that, in rotating loading conveyor 70 between its extended position and its folded-back position, the end of loading conveyor 70 might be obstructed by the ground or other surface on which the apparatus rests. To remove such a restriction, lift foot 26 can be extended to provide sufficient clearance for rotation.

Referring again to FIG. 1 and FIG. 3, in the preferred embodiment the wood processing apparatus 10 is hydraulically powered. An internal combustion engine 84 provides power to a hydraulic pump 86, both of which are mounted on frame 12. Pump 86 is coupled to lift foot 26, saw 38, feed conveyor 68, loading conveyor 70, splitter conveyor 72, and splitter 76 by individual hydraulic lines (not shown). With regard to saw 38, pump 86 powers both the saw itself as well as the pivot mechanism which causes saw 38 to articulate across the end of saw table 32 with a reciprocating motion for cross-cutting an article of wood. Note also that saw 38 can be reciprocated for making a cut by pressing a hip bar 88 which an operator needs only to lean against in order to begin operation. This frees the operator's hands for guiding an article of wood to be cut. Hip bar 88 operates a hydraulic valve which causes saw 38 to move toward the wood. When hip bar 88 is released, saw 38 retracts. Therefore, in operation, hip bar 88 can be used as a direction reversing control as well as to meter the speed of saw movement into the wood.

Rotation of loading conveyor 70 between its extended and folded-back can be effected manually. Preferably, however, rotation is effected with a hydraulic cylinder and chain (not shown) coupled to gear 94 and powered by pump 86. Gear 94 is coupled to loading conveyor 70 and typically sized such that an eight inch (20.32 cm) stroke of the hydraulic cylinder will cause the chain to rotate gear 94 and loading conveyor 70 approximately 147 degrees.

It should also be noted that inclusion both front trailer hitch 22 and rear trailer hitch 30 provides for flexible operation. Since loading conveyor 70 will carry wood to the front of the apparatus when in its extended position, the wood is normally dropped into a truck or other vehicle which is pulling the apparatus from location to location. When the truck is fully loaded, it can be uncoupled from front trailer hitch 22 and replaced with an empty truck. Alternatively, a tractor or the like could be coupled to rear trailer hitch 30 for pulling the apparatus from the opposite direction. In this configuration, it is possible to couple one or more trailers to front trailer hitch 22 onto which the cut wood can be loaded from loading conveyor 70. When a trailer is full, it can be uncoupled and replaced with an empty trailer.

Accordingly, it will be seen that this invention presents a wood processing apparatus which is convenient to operate, easy to move from one location to another, and which provides for sorting as well as cutting logs and other articles of wood. Although the description above contains many specificities, these should not be construed as limiting the scope of the invention but as merely providing illustrations of some of the presently preferred embodiments of this invention. Thus the scope of this invention should be determined by the appended claims and their legal equivalents.

I claim:

1. A transportable apparatus for processing firewood and the like, comprising:

(a) a frame;

(b) frame support means for supporting said frame on a surface, said frame support means coupled to said frame;

(c) saw means for cutting an article of wood to length, said saw means coupled to said frame; and (d) loading conveyor means for moving an article of wood away from said cutting means, said loading conveyor means pivotally coupled to said frame for extension outward from said frame during operation and for folding back over said frame during transportation;

(e) feed conveyor means for carrying an article of wood from said saw means to said loading conveyor means, said feed conveyor means coupled to said frame; and (f) divider means for directing an article of wood toward said feed conveyor means and for diverting an article of wood away from said feed conveyor means according to direction of offset of the center of gravity of said article of wood in relation to said divider means, said divider means coupled to said frame.

2. An apparatus as recited in claim 1, further comprising splitter conveyor means for receiving an article of wood diverted away from said feed conveyor means by said divider means, said splitter conveyor means coupled to said frame.

3. An apparatus as recited in claim 2, further comprising:

(a) splitter means for splitting an article of wood, said splitter means coupled to said frame;

(b) said splitter conveyor means having a first end and a second end, said first end positioned adjacent to said divider means, said second end positioned adjacent to said splitter means;

(c) said loading conveyor means having a first end and a second end, said first end positioned adjacent to said splitter means for carrying an article of wood away from said splitter means after being split.

4. An apparatus as recited in claim 3, further comprising means for adjusting the length into which an article of wood is cut by said saw means.

5. An apparatus as recited in claim 4, wherein said frame support means comprises:

(a) a plurality of wheels rotatably coupled to said frame; and (b) a guide tongue coupled to and extending from said frame, said guide tongue including a support leg and a trailer hitch.

6. An apparatus as recited in claim 5, wherein said saw means comprises a hydraulic circular saw, and wherein said loading conveyor means, said feed conveyor means, said splitter conveyor means, and said splitter means are hydraulically powered.

7. An apparatus as recited in claim 6, further comprising:

(a) an internal combustion engine, said engine coupled to said frame; and (b) a hydraulic pump, said hydraulic pump coupled to said frame and said engine.

8. A wood cutting apparatus, comprising:

(a) a frame;

(b) a saw table, said saw table coupled to said frame, said saw table having a longitudinal axis extending between a first end and a second end;

(c) a saw, said saw coupled to said frame, said saw including a blade positioned substantially perpendicular to said longitudinal axis of said saw table for cross-cutting an article of wood placed on said saw table;

(d) a first conveyor, said first conveyor coupled to said frame in proximity to said saw for receiving a cut article of wood;

(e) a divider, said divider coupled to said frame, said divider being offset from said saw table for directing a cut article of wood toward said first conveyor and for diverting a cut article of wood away from said first conveyor according to direction of offset of center of gravity of said cut article of wood in relation to said divider means; and (f) a second conveyor, said second conveyor pivotally coupled to said frame for extension outward from said frame during operation and for folding back over said frame during transportation, said first conveyor feeding said second conveyor.

9. An apparatus as recited in claim 8, further comprising:

(a) a third conveyor, said third conveyor coupled to said frame, said third conveyor for receiving an article of wood diverted away from said first conveyor by said divider;

(b) a splitter table, said splitter table coupled to said frame, said splitter table for receiving an article of wood from said third conveyor; and (c) a wood splitter, said wood splitter coupled to said frame and positioned near said splitter table and said second conveyor.

10. An apparatus as recited in claim 9, further comprising:

(a) an internal combustion engine, said engine coupled to said frame; and (b) a hydraulic pump, said hydraulic pump coupled to said frame and said engine, said hydraulic pump coupled to said saw, said conveyors and said splitter.

11. An apparatus as recited in claim 10, further comprising:

(a) a plurality of wheels, said wheels rotatably coupled to said frame; and (b) a guide tongue coupled to and extending from said frame, said guide tongue including a support leg and a trailer hitch.

12. A hydraulically powered apparatus for cutting, sorting and stacking logs or the like, comprising:

(a) a frame;

(b) an internal combustion engine, said engine mounted on said frame;

(c) a hydraulic pump, said pump mounted on said frame, said pump coupled to said engine;

(d) a saw table, said saw table mounted on said frame, said saw table including a lower support member and an upper guide member, said upper guide member oriented substantially perpendicular to said lower support member, said lower support member having a longitudinal axis extending between a first end and a second end;

(e) a hydraulic powered saw, said saw mounted on said frame said saw coupled to said pump, said saw including a blade positioned substantially perpendicular to said longitudinal axis of said lower support member for cross-cutting an article of wood placed on said saw table;

(f) a first hydraulic powered conveyor, said first conveyor mounted on said frame in proximity to said saw for receiving a cut article of wood;

(g) a divider, said divider mounted on said frame, said divider offset from said saw table for directing a cut article of wood toward or away from said first conveyor according to position of center of gravity of said cut article of wood in relation to said divider means:

(h) a second hydraulic powered conveyor, said second conveyor pivotally coupled to said frame for extension away from said frame during operation and for folding back over said frame during transportation, said first conveyor feeding said second conveyor, said second conveyor coupled to said pump;

(i) a third hydraulic powered conveyor, said third conveyor mounted on said frame, said third conveyor coupled to said pump, said third conveyor for receiving an article of wood diverted away from said first conveyor by said divider;

(j) a splitter table, said splitter table mounted on said frame, said splitter table for receiving a cut article of wood from said third conveyor;

(k) a hydraulic powered wood splitter, said wood splitter mounted on said frame and positioned near said splitter table and said second conveyor, said wood splitter coupled to said pump;

(l) a plurality of wheels, said wheels rotatably coupled to said frame; and (m) a guide tongue, said guide tongue coupled to and extending outward from said frame, said guide tongue including a trailer hitch, said guide tongue including a support leg.

* * * * *